United States Patent [19]

Jeffrey

[11] 4,049,128

[45] Sept. 20, 1977

[54] CONTROL SYSTEM FOR AUTOMATIC RAILWAY CAR COUPLER

[75] Inventor: William B. Jeffrey, North Huntingdon, Pa.

[73] Assignee: Westinghouse Air Brake Company, Wilmerding, Pa.

[21] Appl. No.: 742,772

[22] Filed: Nov. 18, 1976

[51] Int. Cl.[2] ..... B61G 5/08; B61G 5/10

[52] U.S. Cl. ..... 213/1.6; 213/76; 213/212

[58] Field of Search ..... 213/1.3, 1.6, 76, 211, 213/212; 339/15, 16 R; 137/347, 349

[56] References Cited

U.S. PATENT DOCUMENTS

| | | | |
|---|---|---|---|
| 1,726,508 | 8/1929 | Van Dorn | 213/1.6 |
| 1,924,821 | 8/1933 | Van Dorn | 213/1.6 |
| 3,263,823 | 8/1966 | Gobrecht | 213/1.6 |
| 3,599,803 | 8/1971 | Cope | 213/212 |
| 3,696,941 | 10/1972 | Cope | 213/76 |

*Primary Examiner*—Trygve M. Blix
*Assistant Examiner*—Stuart M. Goldstein
*Attorney, Agent, or Firm*—R. S. Visk; R. W. McIntire, Jr.

[57] ABSTRACT

An electro-pneumatic control system for effecting coupling and uncoupling action of automatic rapid transit type car couplers in a manner which assures that fluid pressure lines are cut off and that electrical contacts are disconnected before actual physical disengagement of the couplers themselves can occur.

8 Claims, 2 Drawing Figures

CONTROL SYSTEM FOR AUTOMATIC RAILWAY CAR COUPLER

BACKGROUND OF THE INVENTION

Normally, automatic couplers used on rapid transit railway equipment, in addition to effecting coupling and uncoupling operations between adjacent cars, also effect connecting and disconnecting operations of the train electrical circuitry and various fluid pressure or pneumatic lines of the train. When uncoupling, it is desirable to disconnect the electrical circuitry and close off the fluid pressure lines before the actual uncoupling of the cars occurs. The circuitry is thus protected from being damaged and fluid pressure is prevented from escaping when separation of the cars occurs. In some of the presently known couplers, self-closing valves are provided in the coupler heads in the fluid pressure connections which are opened and closed automatically and mechanically by coupling and uncoupling action, respectively. These couplers may also be provided with multi-contact blocks in each head for closing and opening the electrical circuitry automatically and mechanically during coupling and uncoupling operation, respectively. During uncoupling it is desirable to open the contacts ahead of the separating action of the coupler heads in order to minimize damage from arcing.

In other known couplers the above described valve and contact actions may be accomplished but by separate actuating mechanism which do not assure that the operations occur in the desired sequential order.

SUMMARY OF THE INVENTION

The object of the present invention is to provide a control system for automatic couplers in which the valve devices for the fluid pressure lines and the multi-contact blocks for the electrical circuitry are not normally actuable automatically and in proper sequential order by the coupling and uncoupling action of the coupler heads.

Briefly, the invention comprises a control system including a plurality of electro-magnet valve devices, a first one of which, when energized, causes a relay valve to effect supply of operating pressure to normally open cut-out cocks interposed in the respective fluid pressure train lines on the car, for closing said cut-out cocks and to a retracting piston for retracting the electrical contact blocks in the coupler and thereby disconnecting the electrical train circuitry, and upon energization of a second one of said magnet valve devices, for causing operating pressure to be supplied to a power cylinder for unlocking the coupler heads for permitting separation thereof, said first and second magnet valve devices being operatively connected with the relay valve in such manner as to assure closing of the cut-out cocks in the train lines and retraction of the electrical contact blocks prior to actual uncoupling or separation of the coupler heads, notwithstanding that said first and second magnet valve devices may be actuated independently, in either order, or simultaneously by the operator. A third electro-magnet valve device is provided in the control system for releasing the trapped actuating pressure from the cut-out cocks and the coupler power cylinder in order to place the fluid pressure train lines, the electrical contact blocks and the coupler heads in condition for coupling operation. If the coupler is provided with centering cylinder devices for centering the coupler head on line with the axis of the car, said centering cylinder devices may be supplied with actuating pressure at the same time that the cut-out cocks and the retracting pistons are supplied.

DESCRIPTION AND OPERATION

Figures 1, 2:
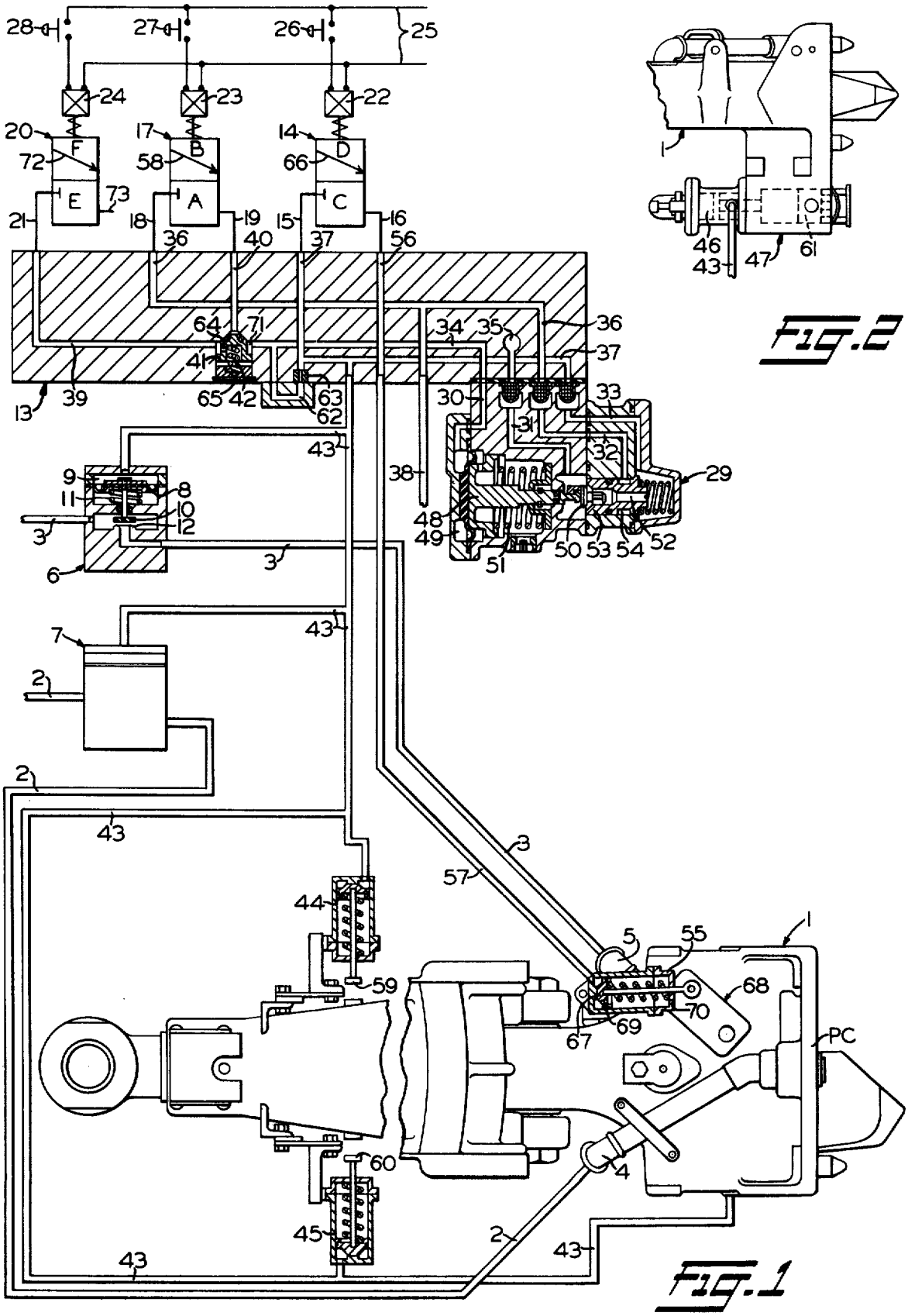
FIG. 1 is a schematic view, partly in section, of a control system embodying the invention.
FIG. 2 is a fragmentary elevational view, in outline, of a portion of one component of the system shown in FIG. 1.

As shown in FIGS. 1 and 2 of the drawing, a control system for automatic rapid transit railway car couplers, of which a coupler mating head 1 is shown, comprises a brake pipe 2 and a straight air pipe 3, both of which are connected to respective fluid pressure pipe connectors 4 and 5 of a pipe connector portion PC of the mating head so that said pipes form continuous fluid pressure train lines extending throughout the length of the train. Respective cut-out valve devices 6 and 7 are interposed in brake pipe 2 and straight air pipe 4 adjacent each end of the car.

Both pipes 2 and 3 are normally charged with fluid pressure at respective preselected degrees for providing fluid under pressure essential for operating and controlling the brakes on the car and the train in a manner well known to those skilled in the art. The manner and details of such operation, however, are not considered necessary to an understanding of the present invention, it being necessary, for the purpose of understanding the present invention, to keep in mind that the purpose of the present invention is to prevent unintentional loss or escape of fluid pressure from pipes 2 and 3 during coupling and uncoupling operations.

Each of the cut-out valve devices 6 and 7, only one of which is shown in detail since the other is identical in structure, comprises a diaphragm 8 subjectable to fluid pressure in a pressure chamber 9 for operating a valve member 10, normally biased by a spring 11 to an open position relative to a valve seat 12, to a closed position on said valve seat. In the open position of valve member 10, communication through straight air pipe 3 is open, whereas in the closed position of said valve member, said communication is interrupted.

A pipe bracket 13 has an uncoupling electro-magnet valve device 14 connected thereto by an inlet pipe 15 and an outlet pipe 16, a cut-off magnet valve device 17 connected thereto by an inlet pipe 18 and an outlet pipe 19, and a coupling electro-magnet valve device 20 connected thereto by an inlet pipe 21.

The several magnet valve devices 14, 17, and 20 are provided with respective solenoids 22, 23, and 24 connected in parallel to an electrical power circuit 25 arranged on the car so as to always have power available for operating the magnet valve device, notwithstanding that the car has been uncoupled from the adjacent car. Push button switches 26, 27, and 28 are serially connected between the respective solenoids 22, 23, and 24 and power circuit 25, and are effective, when operated to respective closed positions, for causing energization of the several solenoids independently of each other.

A relay valve device 29 is also connected to pipe bracket 13 and has formed therein a control passageway 30, an atmospheric passageway 31, a supply passageway 32, and a delivery passageway 33, said control passageway and said atmospheric passageways communicating with a control passageway 34 and an atmospheric passageway 35, respectively, formed in said pipe bracket. A supply passageway 36 and a delivery passageway 37 formed in pipe bracket 13 serve to connect supply passageway 32 and delivery passageway 33 of relay valve device 29 with pipe 18 of cut-off magnet valve device 17 and pipe 15 of uncoupling magnet valve device 14, respectively. Supply passageway 36 is also connected to a pipe 38 leading from a source of fluid under pressure, such as a main reservoir (not shown), for example, said pipe itself, therefore, being considered as a source of fluid pressure so that said supply passageway 36 and supply passageway 32 in relay valve device 29 are constantly charged with fluid pressure therefrom.

Also formed in pipe bracket 13 is a release passageway 39 connecting with pipe 21 of coupling magnet valve device 20, and a branch passageway 40 connecting with pipe 19 of cut-off magnet valve device 17. Control passageway 34, release passageway 39, and branch passageway 40 all meet at a juncture at which a check valve 41 is disposed and biased by a spring 42 to a normally closed position in which release passageway 39 and control passageway 34 are communicated with each other while branch passageway 40 is isolated therefrom. Check valve 41 is operable, in response to pressure in branch passageway 40 sufficient for overcoming spring 42, to an open position in which all passageways 34, 39, and 40 are in communication with each other.

Delivery passageway 37 is connected by a pipe 43 to the respective pressure chambers 9 of cut-off valve 6 and 7, to a pair of centering cylinders 44 and 45, and to a retracting cylinder 46 of an electrical contact portion 47 of mating head 1. See FIG. 2 also. Centering cylinders 44 and 45 are positioned on diametrally opposite sides of mating head 1 on a horizontal axis perpendicular to the longitudinal axis of the mating head, and, when actuated, places the mating head in an aligned position relative to the counterpart mating head on the adjacent car for facilitating coupling operation.

Relay valve device 29 comprises an operating piston 48 subjectable to actuating pressure in a control chamber 49 communicating with control passageway 30, said piston being connected to an exhaust valve member 50, which due to absence of pressure in control chamber 49 and biasing action of a return spring 51 acting on said piston, is operated to an exhaust or release position in which it is shown. In the exhaust position of valve member 50, delivery passageway 37 and pipe 15 of uncoupling magnet valve device 14 are vented to atmosphere via a coaxial passageway 52 extending through a supply valve member 53 in relay valve device 29, past unseated exhaust valve member 50, and exhaust passageways 31 and 35.

When control chamber 49 is supplied with actuating pressure (in a manner to be hereinafter disclosed), piston 48 and exhaust valve member 50 are moved rightwardly, as viewed in the drawing, to first close said exhaust and to then effect rightward movement of supply valve member 53 until supply passageway 32 and delivery passageway 33 are placed in communication with each other via an annular groove 54 formed in said supply valve member, thus causing delivery passageways 33 and 37, and pipe 15 to be charged with fluid pressure prevailing in said supply passageway.

Outlet pipe 16 of uncoupling magnet valve device 14 is connected to an unlatching cylinder device 55 of mating head 1 via a connecting passageway 56 formed in pipe bracket 13 and a pipe 57. Unlatching cylinder 55, when actuated by fluid pressure (in a manner to be hereinafter disclosed), causes unlocking of a latching mechanism (not shown) of mating head 1 in conventional manner, the details of which are not deemed essential to an understanding of the present invention.

In considering the operation of the automatic coupler control system above described, it may be assumed that mating head 1 is coupled to a counterpart mating head (not shown) on an adjacent car (not shown). In the coupled relation of the adjacent mating heads, the several devices comprising the control system are in the respective dispositions as shown in the drawing.

When initiating an uncoupling operation, the operator depresses button 27 for energizing cut-off magnet valve device 17, whereupon said magnet valve is operated from a blocked or closed position, indicated symbolically by reference character A, to a communicating or open position B in which pipes 18 and 19 are placed in communication with each other via a passageway 58. Thus, branch passageway 40 is pressurized with main reservoir pressure from source 38 and supply passageway 36 to operate check valve 41 to its open position and allow pressure from said branch passageway to reach control chamber 49 of relay valve device 29 via control passageways 34 and 30.

Obviously the several magnet valve devices 14, 17, and 20 could be replaced with manually operable valve devices operable to either open or closed positions for establishing or cutting off the several communications controlled by said magnet valve devices. The use of the electrically operable magnet valve devices 14, 17, and 20, however, permits operational control thereof from a remote location, such as the operator's cab of the vehicle, without bulky piping.

With control chamber 49 of relay valve device 29 pressurized, said relay valve device, as above described, operates to cut off atmospheric passageways 31 and 35, and to connect supply passageways 36 and 32 with delivery passageways 33 and 37. Actuating fluid pressure, therefore, may flow via the several branches of pipe 43 to cut-out valve devices 6 and 7, to centering cylinders 44 and 45, and to electrical contact retracting cylinder 46. Flow through brake pipe 2 and straight air pipe 3 is cut off.

Centering cylinders 44 and 45 are actuated to respective abutting positions in which pads 59 and 60 of said centering cylinders are pressed into abutting contact against opposite sides of mating head 1 for aligning said mating head with the longitudinal axis of the car when the car is uncoupled so as to place the mating head in alignment with the counterpart mating head in the event of subsequent recoupling.

Retracting cylinder 46 (see FIG. 2), when actuated by fluid pressure, operates multiple electrical contact blocks 61 of electrical portion 47 to a retracted position out of engagement with counterpart multiple electrical contact blocks (not shown) on the adjacent car. The car is now in condition to be actually uncoupled or separated from the adjacent car.

Subsequently to initial pressurization of control chamber 49 and consequent operation of relay valve device 29 to its fluid pressure supply disposition, it is not necessary to retain button 27 depressed and, therefore, magnet valve device 17 energized in order to maintain said supply disposition of the relay valve device. A fluid pressure maintaining circuit comprising a bypass passageway 62 connected at one end to control passageway 34 and at the other end to delivery passageway 37 with a choke 63 interposed therein serves to maintain control passageway 34 and control chamber 49 pressurized with fluid pressure from said delivery passageway, notwithstanding return of check valve 41 to its closed position (following deenergization of magnet valve device 17) and leakage of fluid pressure from said delivery passageway via a choke 64 and an atmospheric vent port 65 provided in said check valve for a purpose to be hereinafter disclosed. The source of pressure supplied from the main reservoir (not shown) to pipe 38, supply passageway 36, and consequently to delivery passageway 37 (with relay valve 29 in its supply position) is of such volume and pressure that the amount of leakage out choke 64 and vent port 65 is inconsequential with respect to affecting the sufficiency of fluid pressure flow through choke 63 from said delivery pipe to control passageways 34 and 30, and to control chamber 49. Thus, relay valve device 29 is maintained in its supply disposition until such time that pressure is released from control chamber 49.

The final step in the uncoupling phase of operation necessitates energization of uncoupling magnet valve device 14 by depressing button 26, whereupon said magnet valve device is operated from a blocked or closed position, indicated symbolically by reference character C, to a communicating or open position D in which fluid pressure in delivery passageway 37 and pipe 15 is communicated, via a passageway 66, to pipe 16, connecting passageway 56, and pipe 57 to unlatching cylinder 55. Unlatching cylinder 55, in response to fluid pressure supplied thereto and acting on a piston member 67 thereof, operates a latching mechanism 68 to an unlatched position for placing the mating heads in condition for separation, in manner well known to those skilled in the art. Subsequently to unlatch the coupler head 1 by cylinder 55, uncoupling magnet valve device 14 is deenergized by releasing button 26 and is restored to its closed position C. Fluid pressure in pipe 16, in connecting passageway 56, in pipe 57, and in cylinder 55 is released via a choke 69 connecting opposite sides of piston 66 and via an atmospheric port 70 in the cylinder casing, following which the latching mechanism assumes a pre-coupling disposition whereby said latching mechanism may engage and automatically lock with the counterpart mating head upon subsequent coupling of adjoining cars.

With cut-off valves 6 and 7 in their respective closed positions, with centering cylinders 44 and 45 in their respective centering positions, with the electrical contact blocks 61 in their retracted position, and with the latching mechanism (not shown) in its unlatched position, the cars may be uncoupled and physically separated, it being understood that the uncoupling operation above described in connection with mating head 1 is duplicated in the counterpart mating head (not shown) on the adjacent car.

In the coupling operation, after two cars are joined, mating head 1, in conventional manner, automatically couples and locks with the counterpart mating head on the adjoining car, as above noted. In order to restore communication through brake pipe 2 and straight air pipe 3, and reconnection of the electrical contact blocks 61, fluid pressure must be released from pipe 43. To accomplish this, coupling magnet valve device 20 is energized by depressing button 28, whereupon said magnet valve device is operated from a blocked or closed position, indicated symbolically by reference character E, to a vent position F in which fluid pressure from control chamber 49 of relay valve device 29 via control passsageways 30 and 34, an annular space 71 surrounding check valve 41, release passageway 39, pipe 21, a passageway 72 in the magnet valve device, and an atmospheric vent 73 is vented to atmosphere.

Following release of fluid pressure from control chamber 49 and consequent restoration of relay valve device 29 to its release disposition, magnet valve device 20 may be deenergized by releasing button 28, whereupon fluid pressure in pipe 43 is released to atmosphere via delivery passageways 37 and 33, passageway 52, past unseated exhaust valve 50, and via exhaust passageways 31 and 35. Consequently, cut-off valve devices 6 and 7 resume respective open positions, and the electrical contact blocks 61 in mating head 1 resume their engaged relation with the contact blocks in the counterpart mating head.

Subsequently to completion of the coupling operation, as above described, any residual pressure in pipe 43, in control chamber 49, and in the several passageways 30, 34, 33, 37, 39 may escape via choke 64 and vent port 65 in check valve 41 or via choke 63 and passageway 62, thence via said choke 64 and vent port 65.

It should be understood that the adjoining car to which the car having the mating head 1 and the related control system, as above described, is also equipped with a coupler mating head and a control system therefor identical in structure and operation to that above described, and therefore, the illustration and description thereof has not been duplicated.

Having now described the invention, what I claim as new and desire to secure by Letters Patent, is:

1. Control apparatus for an automatic railway car coupler comprising one mating head, including an electrical contact portion for connecting electrical train circuitry and a pipe connector portion for connecting fluid pressure train lines, said mating head being carried on one car and adaptable for coupling with a counterpart mating head on another car for automatically and concurrently effecting coupling of the cars and connection of the respective electrical circuitry and pipe lines of the train, said control apparatus comprising:

a. a source of fluid under pressure;

b. normally open cut-out valve means interposed in the respective fluid pressure train lines and operable, in response to actuating fluid pressure, to respective closed positions for interrupting flow through said train lines;

c. centering means carried by the respective mating heads in normally disengaged positions relative to the mating heads and operable, responsively to actuating fluid pressure, to respective abutting positions with the mating heads and in which said mating heads are positioned in axial alignment with each other prior to coupling engagement;

d. retracting means disposed on the respective mating heads and operable, in response to actuating fluid pressure, to respective retracted positions in which electrical contact blocks of the electrical portions of the mating heads, respectively, are electrically disengaged from each other;

e. latching means carried by the respective mating heads normally biased to respective latching positions for locking the mating heads, upon engagement, in a coupled relation and being operable, in response to actuating fluid pressure, to an unlatching position for releasing the mating heads from said coupled relation prior to disengagement thereof; and f. actuating means operable, at will, for effecting supply of actuating fluid pressure from said source to said latching means for effecting sequential operation thereof to their unlatching positions subsequently to concurrent operation of said cut-out valve means, said centering means, and said retracting means to their closed positions, abutting positions, and retracted positions, respectively.

2. Control apparatus for an automatic railway car coupler, as set forth in claim 1, wherein said centering means includes, on each mating head, a pair of centering cylinder devices positioned on diametrally opposite sides of the mating head on a horizontal axis perpendicular to the longitudinal axis of the mating head, said cylinder devices being provided with respective pads movable into abutting contact with the mating head upon actuation of the cylinder devices.

3. Control apparatus for an automatic railway car coupler, as set forth in claim 1, wherein said retracting means comprises, on each mating head, a retracting cylinder device operably connected to the electrical contact blocks of the respective mating head.

4. Control apparatus for an automatic railway car coupler, as set forth in claim 1, wherein said latching means includes, on each mating head:

a. a latching mechanism for locking the mating heads in coupled relation; and b. an unlatching cylinder device operable responsively to said actuating fluid pressure for operating said latching mechanism to said unlatched position.

5. Control apparatus for an automatic railway car coupler, as set forth in claim 4, wherein said cut-out valve means, said centering means, and said retracting means comprise a plurality of fluid pressure operable devices, and said actuating means includes:

a. a relay valve device having a control chamber and being interposed between said source of fluid under pressure and said plurality of fluid pressure operable devices, said relay valve device normally occupying a closed position in which said source of fluid under pressure is cut off from said plurality of fluid pressure operable devices and being operable, in response to control pressure supplied to said control chamber from said source, to a supply position in which delivery of actuating fluid pressure is effected from said source to said plurality of fluid pressure operable devices via a delivery passageway;

b. a cut-off valve device interposed between said source of fluid under pressure and said relay valve device, said cut-off valve device normally occupying a closed position in which said control pressure chamber is cut off from said source of fluid under pressure and being operable, at will, to an open position in which said control pressure chamber is communicated with said source; and c. an uncoupling valve device interposed between said cut-off valve device and said unlatching cylinder device in parallel relation with the relay valve device, said uncoupling valve device normally occupying a closed position in which communication between said cut-off valve device and said unlatching cylinder device is cut off and being operable, at will, to an open position in which said fluid pressure supplied from said source to said plurality of fluid pressure operable devices is also supplied to said unlatching cylinder device.

6. Control apparatus for an automatic railway car coupler, as set forth in claim 5, wherein said actuating means further includes a coupling valve device communicating with the relay valve device in parallel relation with the cut-off valve device, said coupling valve device normally occupying a closed position in which the control pressure chamber of the relay valve device is closed to atmosphere and being operable, at will, to an open position in which said control pressure chamber is vented to atmosphere for effecting restoration of the relay valve device to its said closed position in which said cut-off valve means, said centering means, and said retracting means are relieved of actuating fluid pressure.

7. Control apparatus for an automatic railway car coupler, as set forth in claim 6, further including a fluid pressure maintaining circuit comprising a bypass passageway having a choke interposed therein communicating said control chamber, via said bypass passageway, with said delivery passageway independently of the cut-off valve device.

8. Control apparatus for an automatic railway car coupler, as set forth in claim 6, wherein said cut-off valve device, said uncoupling valve device, and said coupling valve device comprise respective electrically energizable electro-magnet valve devices and respective manually operable push buttons for energizing the electro-magnet valve devices.

* * * * *